US005957020A

United States Patent [19]

Truemner et al.

[11] Patent Number: 5,957,020

[45] Date of Patent: Sep. 28, 1999

[54] METHOD AND APPARATUS FOR PERFORATING CORRUGATED TUBING

[76] Inventors: Dale Truemner, 1390 S. Brown Rd., Pigeon, Mich. 48753; Richard Booms, 2581 Sand Beach Rd., Bad Axe, Mich. 48413

[21] Appl. No.: 08/752,204

[22] Filed: Nov. 19, 1996

[51] Int. Cl.[6] ..... B26D 3/14

[52] U.S. Cl. ..... 83/304; 83/318; 83/698.61

[58] Field of Search ..... 83/54, 304, 340, 83/672, 592, 318, 319, 507, 700, 303, 698.61

[56] References Cited

U.S. PATENT DOCUMENTS

| | | | |
|---|---|---|---|
| 3,824,886 | 7/1974 | Hegler . | |
| 4,122,590 | 10/1978 | Spencer | 83/54 |
| 4,167,131 | 9/1979 | Habas et al. | 83/304 |
| 4,180,357 | 12/1979 | Lupke et al. . | |
| 4,218,164 | 8/1980 | Lupke et al. . | |
| 4,856,396 | 8/1989 | Brinkmeier et al. | 83/304 |
| 5,381,711 | 1/1995 | Truemner et al. . | |
| 5,385,073 | 1/1995 | Truemner et al. . | |
| 5,572,917 | 11/1996 | Truemner et al. . | |

*Primary Examiner*—Kenneth E. Peterson
*Attorney, Agent, or Firm*—Weintraub & Brady, P.C .

[57] ABSTRACT

An apparatus for perforating corrugated tubing includes at least one pair of feeder-cutter wheels, each feeder-cutter wheel including a worm a helical threading disposed at an angle on the worm for intersecting corrugations of corrugated tubing, and a cutter disposed on the worm in line with the threading, a drive shaft for each feeder-cutter wheel, each of the drive shafts including a front end portion having a longitudinal axis, one of the feeder-cutter wheels being coaxially mounted to a front end portion of each of the drive shafts for rotation thereby; and an assembly for moving each feeder-cutter wheel in a direction which is substantially transverse to the longitudinal axis of its associated drive shaft front end portion. In a preferred apparatus, the wheel moving assembly is operable to move the feeder-cutter wheels from a first position, in which the wheels are spaced to make contact with the tubing, to a second position, in which the wheels are spaced to allow the tubing to pass therebetween without substantial contact therewith. The present invention also includes a method of perforating corrugated tubing,which includes the steps of feeding a piece of corrugated tubing into a tubing perforation machine, the machine having a plurality of feeder-cutter wheels thereon, each feeder-cutter wheel including a worm, a helical threading disposed at an angle on the worm, and a cutter disposed on the worm in line with the threading; moving the tubing through the machine by rotating the feeder-cutter wheels, the helical threadings riding in corrugations of the tubing to advance the tubing as the wheels are rotated, the cutters intermittently intersecting the tubing to cut perforations therethrough as they rotate around the wheels, the tubing traveling along a longitudinal axis therof; and moving each feeder-cutter wheel outwardly away from the tubing, in a direction which is substantially transverse to the longitudinal axis of the tubing to temporarily disable the cutters.

2 Claims, 7 Drawing Sheets

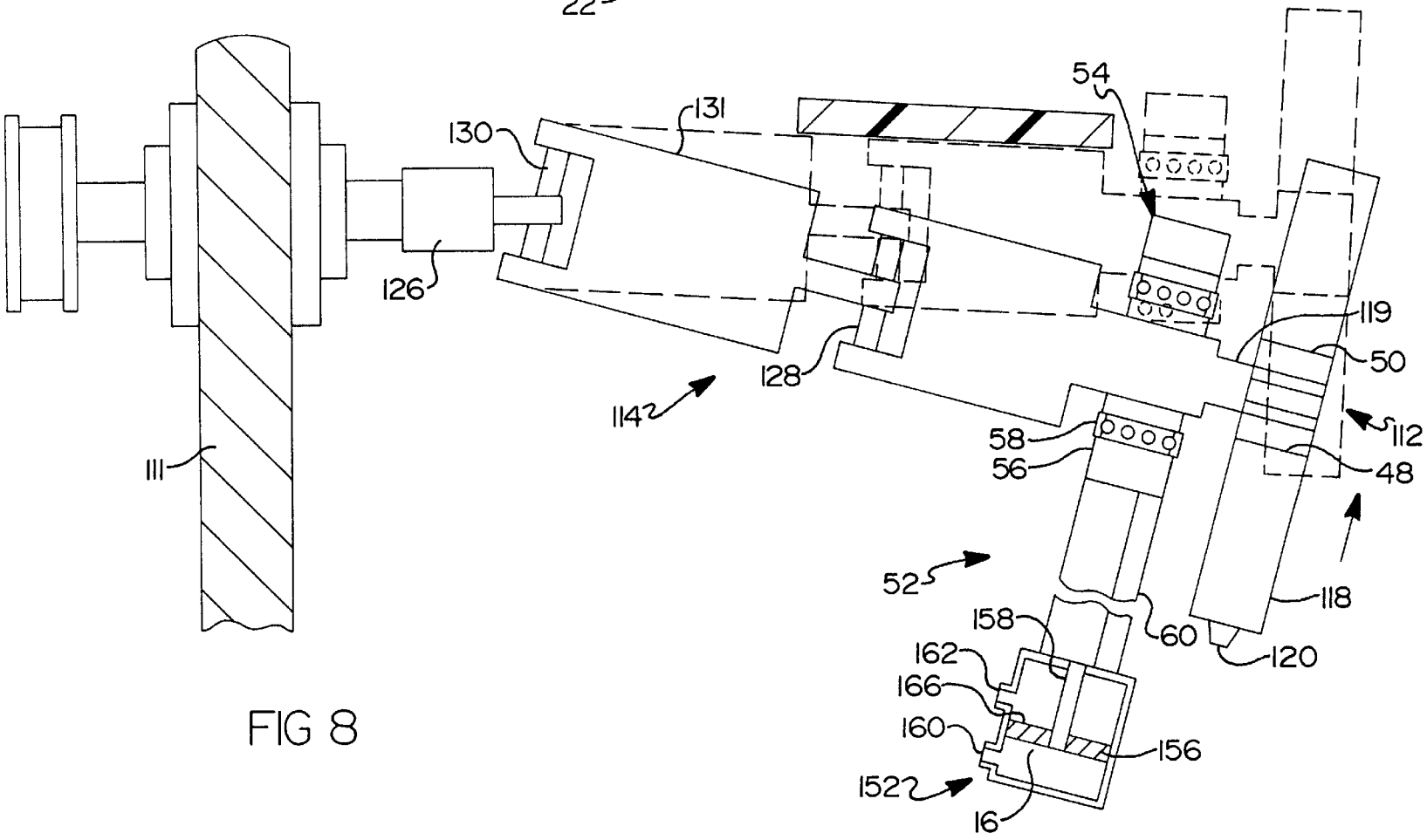
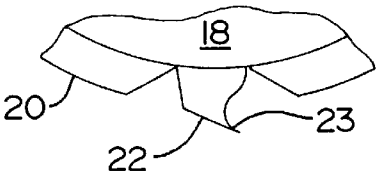
FIG 2A
FIG 8

FIG 6
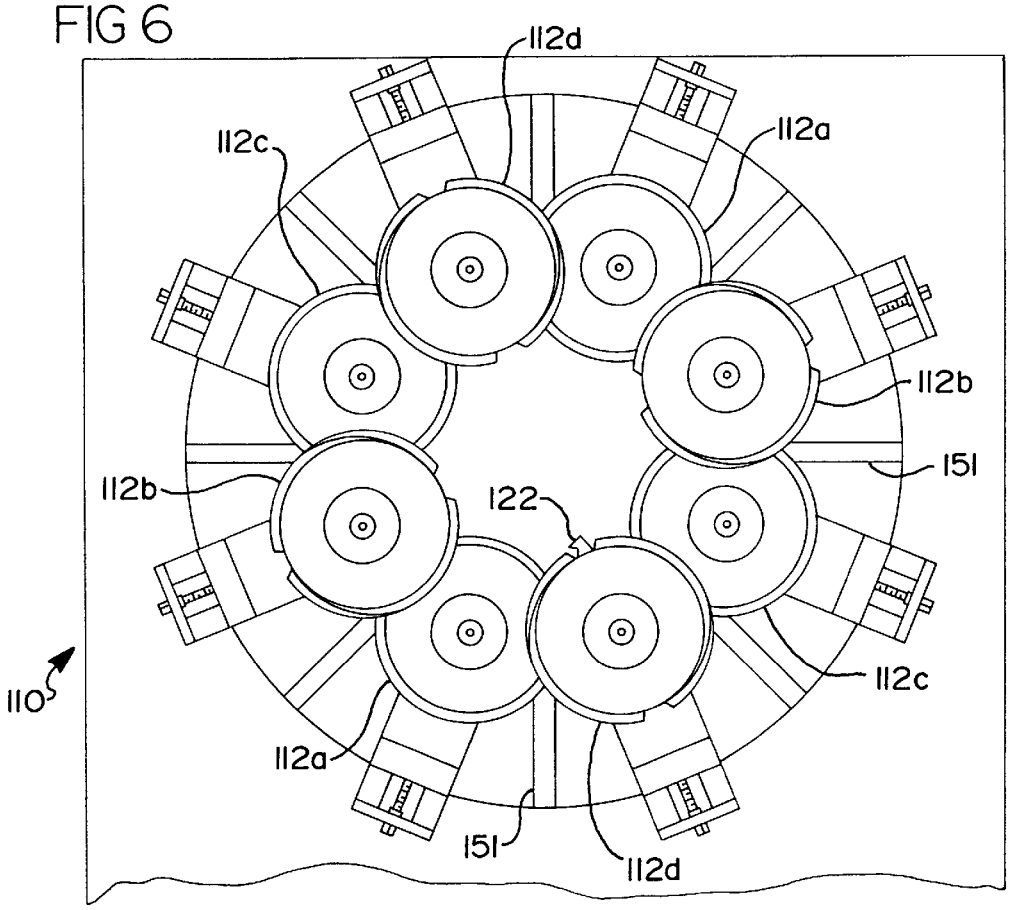
FIG 7A
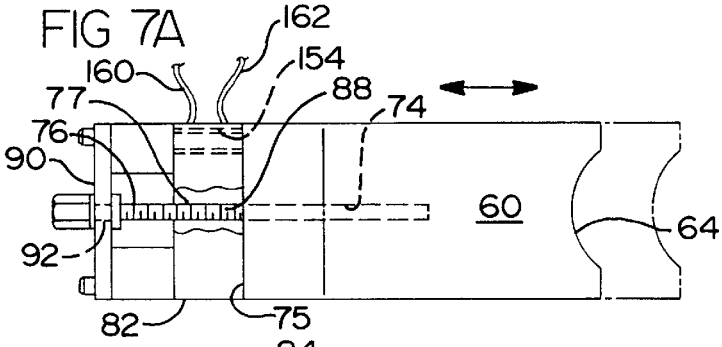
FIG 7C
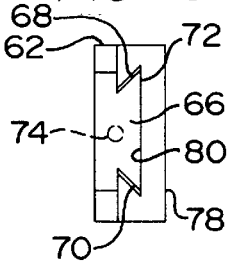
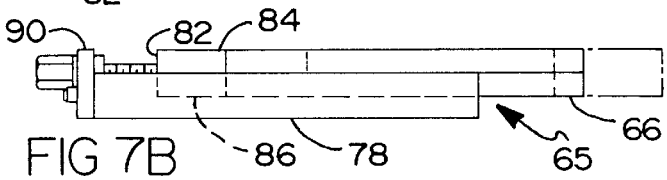
FIG 7B
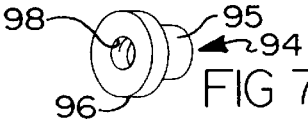
FIG 7D

METHOD AND APPARATUS FOR PERFORATING CORRUGATED TUBING

BACKGROUND OF THE INVENTION

1. Field of the Invention

The present invention relates to a method and apparatus for perforating corrugated tubing. More particularly, the present invention relates to a method and apparatus for perforating corrugated tubing as the tubing is being moved at a high speed therethrough. Even more particularly, the present invention related to a method and apparatus for perforating corrugated tubing which is selectively interruptable to leave portions of the tubing uncut.

2. Description of the Background Art

Machines for perforating corrugated tubing have been in use for some time. One such machine is disclosed in U.S. Pat. No. 3,824,886, to Hegler, which teaches an apparatus for cutting apertures in corrugated tubing by rotating a cutter circumferentially around the tubing. The cutter of Hegler is disposed in a ridge on a wheel, which is driven by a transmission. The wheel and cutter cooperate with a roller to rotate spirally around the tubing. While offering a relatively simple design to achieve its ends, the apparatus of Hegler is necessarily limited to a relatively low speed operation due to the necessity of the wheel and cutter traveling the entire length of the corrugation. Increasing the traveling speed of the wheel beyond modest levels would result in miscuts in the tubing, such as cuts in the side walls of the corrugations instead of the valleys thereof. Further, excessive wheel speed could cause the wheel to jump past some corrugations, thus missing areas of the tubing and leaving those areas unperforated.

U.S. Pat. No. 4,180,357 to Lupke et al. discloses another apparatus for perforating corrugated tubing, which has multiple lead screws for driving tubing along an axial path, the lead screws meshingly engaging with the corrugations of the tubing. Each of the lead screws is mounted on an axis of rotation parallel to the axial path of the tubing, and each lead screw carries a cutter thereon, flanked on each side by a raised rib. The cutter is in a plane substantially at a right angle to the axial path, and the cutter intermittently intersects the tubing. The apparatus of Lupke rotates the lead screws using a system of gear wheels which are coordinated such that pairs of lead screws cut the tubing simultaneously. The apparatus of Lupke can cut tubing at a maximum horizontal speed of 20 feet/minute. At greater speeds, the apparatus experiences difficulty in properly aligning the cutter and perforating the tubing.

An improvement on the basic design of Lupke is disclosed in U.S. Pat. No. 4,218,164, also issued to Lupke et al., in which a plurality of helically raised ribs are centrally disposed on lead screw members, replacing the straight ribs of the Lupke '357 patent. A cutter is disposed at the end of each helical rib. The helical rib tends to facilitate entry of the cutter into the valley of the corrugation. The rib of the Lupke '164 apparatus extends around only a portion of the circumference of the shaft, thus continuing the teaching of intermittent intersection of the tubing by the cutter, as taught in the earlier Lupke patent. The apparatus of the Lupke '164 patent achieves a horizontal tubing speed of about 40 to 50 feet/minute. At speeds in excess of 50 feet/minute, the second Lupke apparatus tends to climb the side walls of the corrugations and to perforate either those side walls or the crown of the corrugation. Lupke et al. overcame the limitation of rotating the entire cutter wheel around the tubing as taught in Hegler. In the first Lupke apparatus, the plurality of raised ribs essentially slowed the horizontal movement of the tubing long enough to effect the perforation. The second Lupke apparatus substituted the helical rib for the plurality of straight ribs, alleviating the need to slow or stop the horizontal travel of the tubing to effect the perforation. However, when attempting to operate the second Lupke apparatus at speeds in excess of 50 feet/minute, miscuts are experienced. Also, problems are encountered with the feed worms of Lupke. At high speeds, the vertical sides of the feed worms are unable to maintain their helical course in the corrugation. Thus, the worms tend to climb the side walls of the corrugations, crushing the crown of the tubing and skipping parts of the corrugation. Also, neither Lupke or the other available art teaches any method of intermittent cutting, that is, controlled perforation of corrugated tubing which can be intentionally selectively interrupted to leave a portion of the tubing uncut.

A need still exists in the art for a reliable high-speed apparatus for perforating corrugated tubing. Ideally, such an apparatus would be temporarily selectively interruptible to pause in perforating tubing during operation thereof, to leave selected portions of tubing unperforated.

SUMMARY OF THE INVENTION

The present invention provides an improved method and apparatus for perforating corrugated tubing in which a perforating process is selectively interruptible to leave portions of the tubing unperforated.

An apparatus according to the present invention, generally, comprises:

a) at least one pair of feeder-cutter wheels, each feeder-cutter wheel comprising a worm, a helical threading disposed at an angle on the worm for intersecting corrugations of corrugated tubing, and a cutter disposed on the worm in line with the threading, b) a drive shaft for each feeder-cutter wheel, each of the drive shafts comprising a front end portion having a longitudinal axis, one of the feeder-cutter wheels being coaxially mounted to a front end portion of each of the drive shafts for rotation thereby; and c) means for moving each feeder-cutter wheel in a direction which is substantially transverse to the longitudinal axis of its associated drive shaft front end portion.

In the preferred apparatus hereof, the wheel moving means is operable to move the feeder-cutter wheels from a first position, in which the wheels are spaced to make contact with the tubing, to a second position, in which the wheels are spaced to allow the tubing to pass therebetween without substantial contact therewith.

The present invention also includes a method of perforating corrugated tubing. A method according to the present invention, generally, comprises the steps of:

a) feeding a piece of corrugated tubing into a tubing perforation machine, the machine having a plurality of feeder-cutter wheels thereon, each feeder-cutter wheel comprising a worm, a helical threading disposed at an angle on the worm, and a cutter disposed on the worm in line with the threading;

b) moving the tubing through the machine by rotating the feeder-cutter wheels, the helical threadings riding in corrugations of the tubing to advance the tubing as the wheels are rotated, the cutters intermittently intersecting the tubing to cut perforations therethrough as they rotate around the wheels, the tubing traveling along a longitudinal axis therof; and c) moving each feeder-cutter wheel outwardly away from the tubing, in a direction which is substantially transverse to the longitudinal axis of the tubing to temporarily disable the cutters.

Preferably, the wheel moving step moves the wheels from a first position, in which the wheels are spaced to make contact with the tubing, to a second position, in which the wheels are spaced to allow the tubing to pass therebetween without substantial contact therewith.

Accordingly, it is an object of the present invention to provide an improved method and apparatus for reliably perforating corrugated tubing at a relatively high speed in excess of 50 feet/minute, preferably at speeds of 150–200 feet/minute.

It is another object of the present invention to provide a method and apparatus for perforating corrugated tubing which is selectively interruptible to leave portions of the tubing unperforated.

Other objects, features, and advantages of the present invention will become apparent from a review of the specification hereof. For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 2A is a partial end view of a feeder-cutter wheel, showing a cutting blade thereof.

FIG. 6 is a front plan view of the apparatus of FIG. 5 with the feeder-cutter wheels installed;

FIG. 7A is a top plan view of a slide assembly which is a part of the apparatus of FIGS. 5–6;

FIG. 7B is a side plan view of the slide assembly of FIG. 7A;

FIG. 7C is an end plan view of the slide assembly of FIG. 7A;

FIG. 7D is a detail perspective view of a spacer which is a component of the slide assembly of FIG. 7A; and FIG. 8 is a top plan view of a feeder-cutter wheel and associated drive shaft of the apparatus of FIG. 5, with a back wall of a housing shown in cross-section, with a disabled position of the drive shaft and feeder-cutter wheel shown in solid lines, and with an operative position of the drive shaft and feeder-cutter wheel shown in phantom.

DETAILED DESCRIPTION OF THE PREFERRED EMBODIMENT

Figure 1:
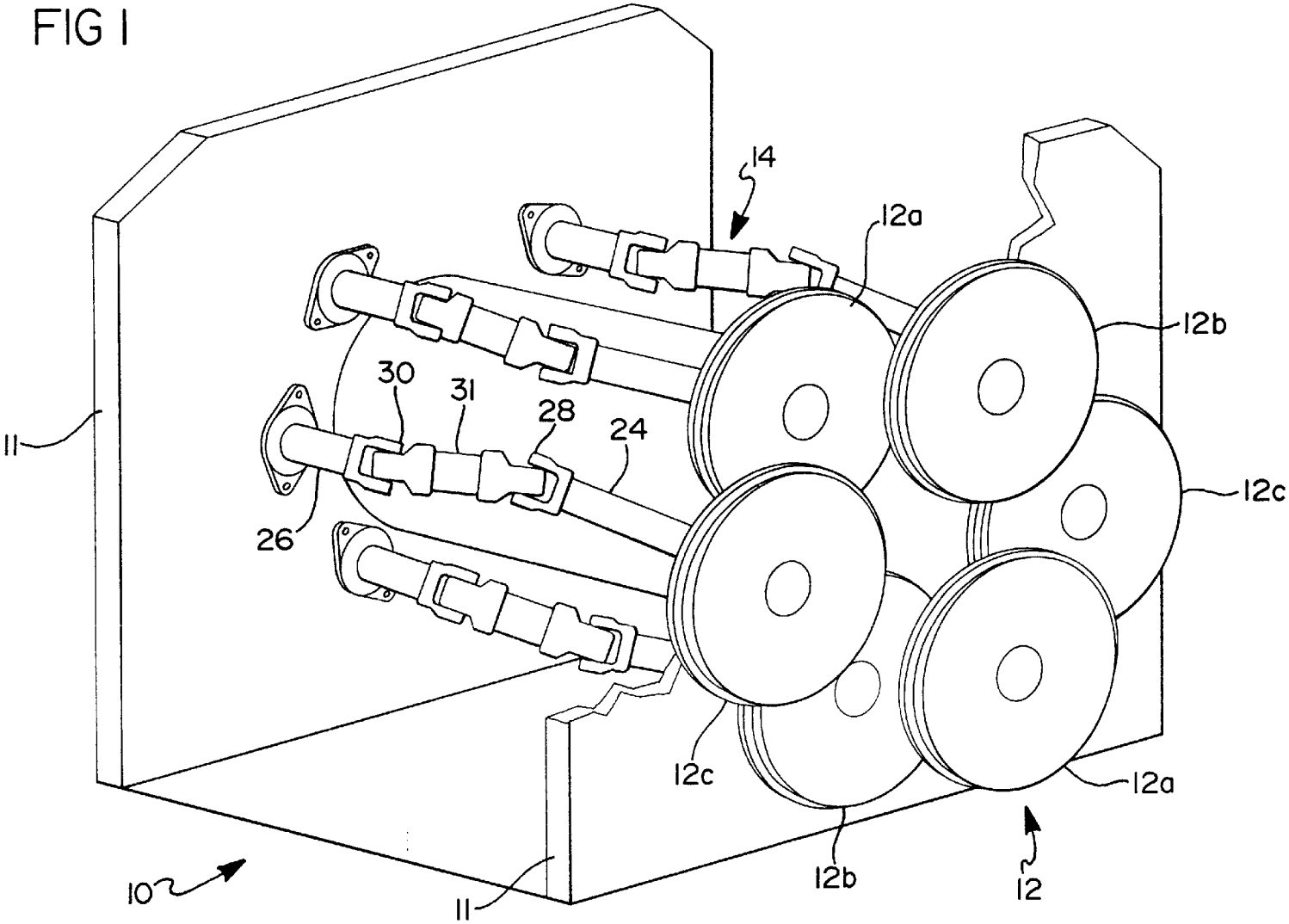
FIG. 1 is a perspective view, partially cut away, of an apparatus for perforating corrugated tubing in accordance with a first embodiment of the present invention.
Figure 2:
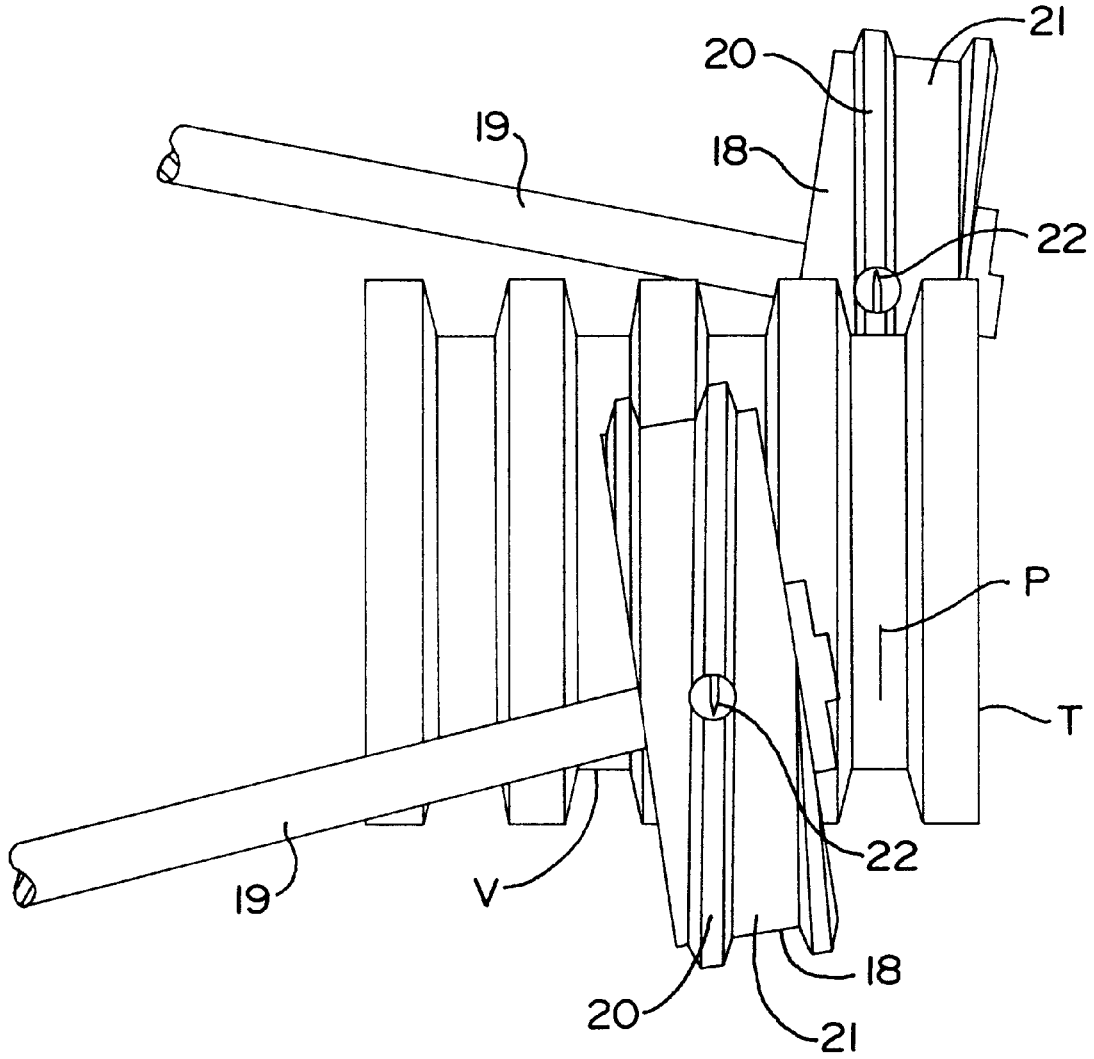
FIG. 2 is a side view of a pair of feeder-cutter wheels, and a portion of their respective associated drive shafts, which are parts of the apparatus of FIG. 1, showing a section of corrugated tubing moving therebetween.

With reference now to FIGS. 1–4, an apparatus for perforating corrugated tubing, in accordance with the present invention, is shown generally at 10. The apparatus 10 includes a plurality of feeder-cutter wheels 12, a plurality of drive shafts 14 on which the wheels 12 are mounted, and means 16 for rotating the drive shafts. The apparatus 10 further has a housing 11 for supporting and containing various components of the apparatus 10 as will be described further hereinbelow.

Each of the feeder-cutter wheels 12 includes a worm 18, a threading 20 and a cutter 22. The worm 18 is a solid wheel body having a cylindrical outer surface 21, and the diameter of the worm is determined by the size of the tubing T to be perforated. The worm 18 is joined forwardly on a front end portion 19 of a drive shaft 14.

The threading 20 is helically disposed on the outer surface 21 of the worm 18. The threading 20 facilitates the intersection and intermeshing of the wheel 12 with the corrugated tubing T. The threading 20 has beveled edges, and rides in the valleys V of the corrugations in the tubing T, cooperating with the cutter 22 to drive the tubing forwardly through the apparatus 10 and to intermittently perforate the tubing as the wheel 12 rotates.

The cutter 22 is disposed in line with the helical threading 20 on the outer surface 21 of the worm 18. The cutter 22 is a hardened and sharpened bit which is fixedly mounted on to the worm 18, the cutter having a hook 23 extending slightly above the threading 20 for cutting slitted perforations P into the corrugations of the tubing T.

The feeder-cutter wheels 12 are larger in size than the cutter wheels previously known in the art. Prior apparatus, particularly the Lupke machines, used relatively small cutter wheels, about 1 to 1.5 inches in diameter. The present invention, as embodied in the apparatus 10, uses wheels larger than the Lupke machines by a factor ranging from 3 to 6. When it is desired to perforate tubing T of a larger diameter, feeder-cutter wheels 12 of a smaller diameter are used. Correspondingly, when smaller tubing T is to be perforated, feeder-cutter wheels 12 of a larger diameter are used.

In order to use wheels 12 larger than those previously known in the art, and to use a plurality of pairs of wheels as is preferred with the present invention, the wheels 12 are grouped in pairs, and the individual wheels of each pair are offset in different operating planes from one another. For example, and as shown in FIG. 1, each wheel of a first pair of wheels, denoted here as 12*a*, is situated in a different plane of rotation. Each succeeding pair of wheels 12*b*, 12*c* then includes a first wheel disposed in a different and distinct plane of rotation from the second wheel of the pair. Here the second pair is denoted as 12*b* and the third pair as 12*c*. Not only does this placement of the wheels 12, in different planes, achieve the use of larger wheels than were used previously, but also the placement of wheels in different planes allows for interchangability of wheels of different diameters without necessitating a change of drive shafts 14 or the calibrations thereof.

As shown in FIG. 1, the apparatus 10 according to the first embodiment of the present invention has three pairs of feeder-cutter wheels, the wheels indicated generally as 12 and in pairs as 12*a*, 12*b*, and 12*c*. The design of the apparatus 10 is such that the wheels 12 of each pair are disposed in different planes from one another. Specifically, the worms 18 of the wheels 12 are disposed in distinct planes. A single wheel of the first pair 12*a* is in a first plane. The corresponding wheel of the first pair 12*a* is in a second plane. In a similar fashion, the first and second wheels of the second pair 12*b* are disposed in different planes from one another, as are the first and second wheels of the third pair 12*c*.

The design of spacing the wheels 12 in different planes, as opposed to one plane, allows for some overlapping of the wheels 12, as shown, and offers a significant advantage over previous devices for perforating corrugated tubing. Specifically, the orientation of the wheels in different planes allows for the use of different sized wheels on the same apparatus 10. Thus, one apparatus 10 may be used to perforate tubing of various diameters. In achieving this versatility, it is noteworthy that the present apparatus 10 allows for this changing of wheels 12 without requiring recalibration and resynchronization of the newly mounted wheels 12 and their associated drive shafts. This is due in part to the elimination of gears for driving the apparatus. Previously known tubing perforation apparatus required new gear trains when using cutter wheels of different sizes. The present invention eliminates this additional cost.

Figure 3:
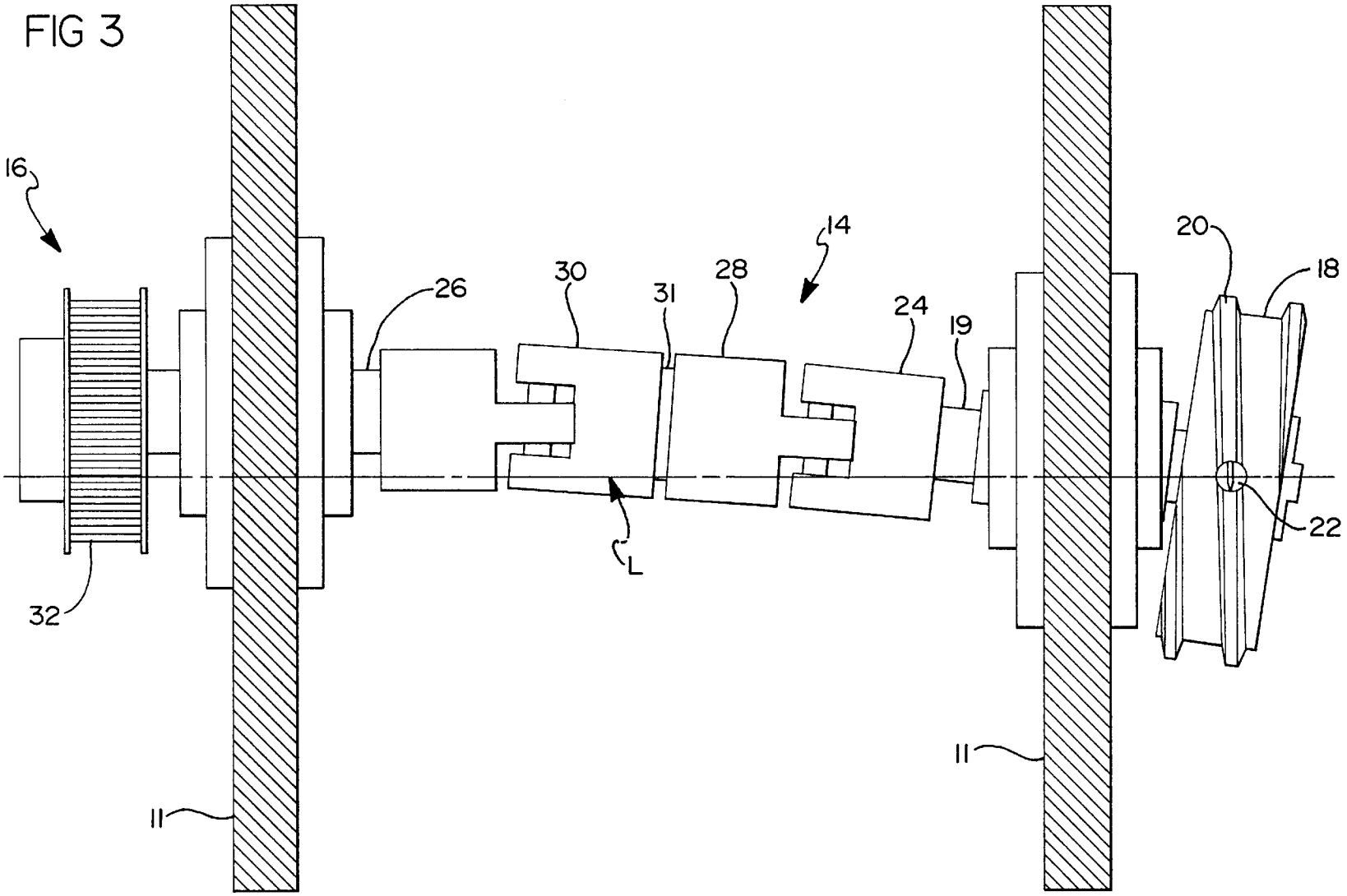
FIG. 3 is a top plan view of a feeder-cutter wheel and associated drive shaft of the apparatus of FIG. 1, with walls of a housing shown in cross-section.

Each wheel 12 is fixedly mounted on a front end portion 19 of a drive shaft 14 for concurrent rotation therewith. Each drive shaft 14 includes a front end portion 19, a forward portion 24, and a rearward portion 26, and at least one U-joint 28 interconnecting the forward portion and the rearward portion. As shown in FIG. 3, the back end of the front end portion 19 is joined to, and is integrally formed with, the forward portion 24. The forward portion 24 is then connected to a first U-joint 28. In a preferred embodiment hereof, the drive shaft 14 includes two U-joints 28, 30 connected by an intermediate piece 31, and the second U-joint 30 is connected to the rearward portion 26 of the drive shaft 14. The rearward portion 26 of the drive shaft 14 passes through the housing 11 and is connected to means 16 for driving, as will be further described hereinbelow.

The drive shaft 14, and the feeder-cutter wheel mounted thereon, are offset at an angle relative to the axial path of the tubing T and the apparatus 10, the axis of the tubing T and the apparatus 10 being identical or coaxial and shown as L in FIG. 3. To achieve maximum throughput speed in perforating the tubing T, the drive shaft 14 and its corresponding wheel 12 are disposed at an angle substantially equal to the average of the helical angles of the threadings upon the feeder-cutter wheels 12 of the apparatus 10. This angled disposition of the feeder-cutter wheels supplies sufficient pressure on the wheel 12 to keep the threading 20 rotating through the valley V of the tubing T, thus perforating the tubing in the valley thereof when the cutter 22 is rotated therethrough, rather than in the side wall or crown of the tubing corrugations. In addition, throughput speeds of up to 200 feet per minute are attainable using the apparatus 10 of the present invention due to improved contact between the threading 20 and the valley V of the tubing, due to the angled placement of the feeder-cutter wheels. Thus, the apparatus 10 of the present invention achieves higher throughput speeds than the previously known devices while simultaneously minimizing damage to the tubing during the perforation process.

It has been found that to most efficiently effect the optimal offset angle, at least one U-joint is needed and two U-joints 28, 30 are preferred. The U-joints 28, 30 allow for the bending of the drive shaft 14 to allow angled placement of the feeder-cutter wheel 12, while still effectively transmitting rotational power.

Figure 4:
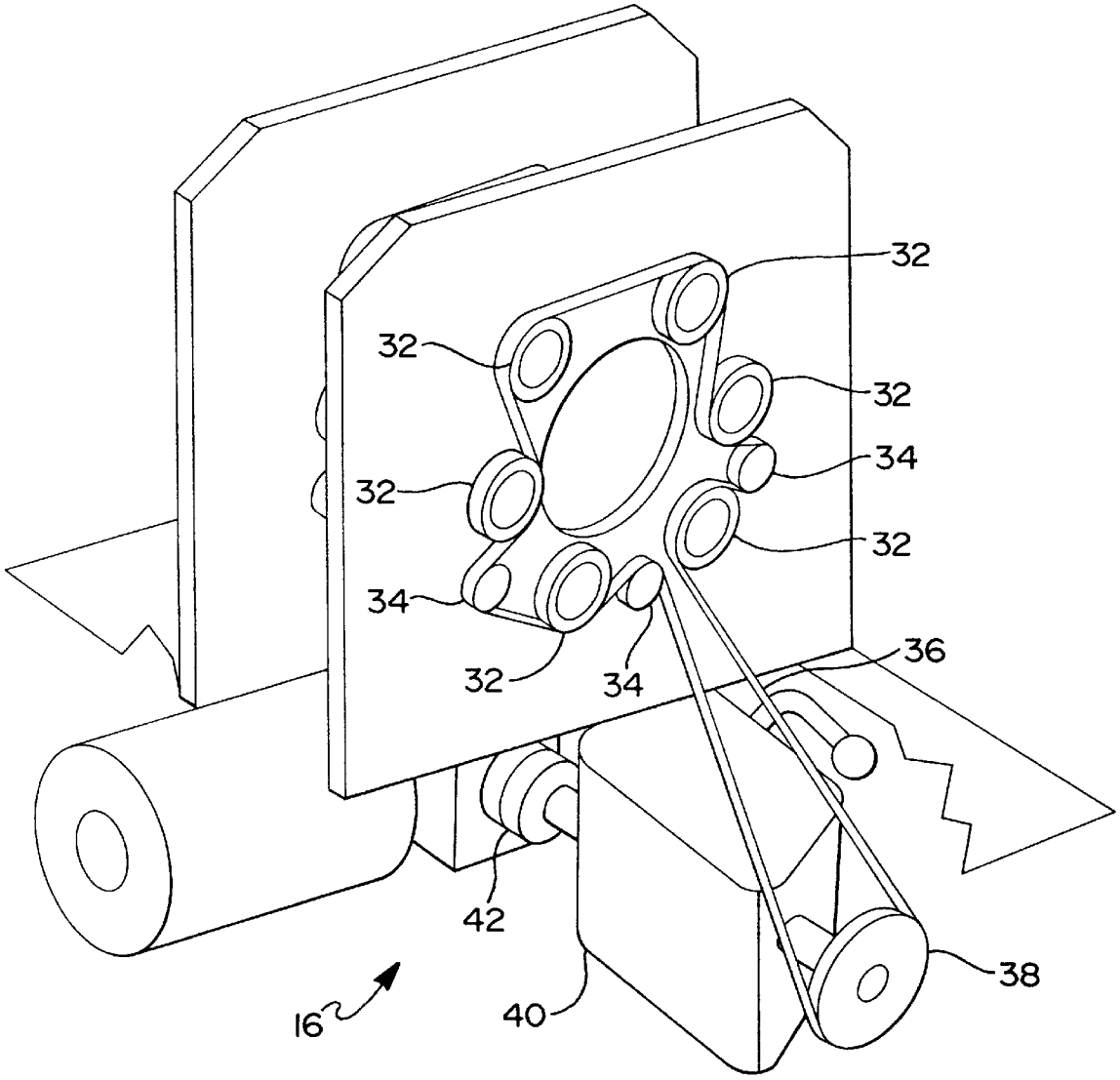
FIG. 4 is a rear perspective view, partially cut away, of the apparatus of FIG. 1, showing a drive mechanism.
Figure 5:
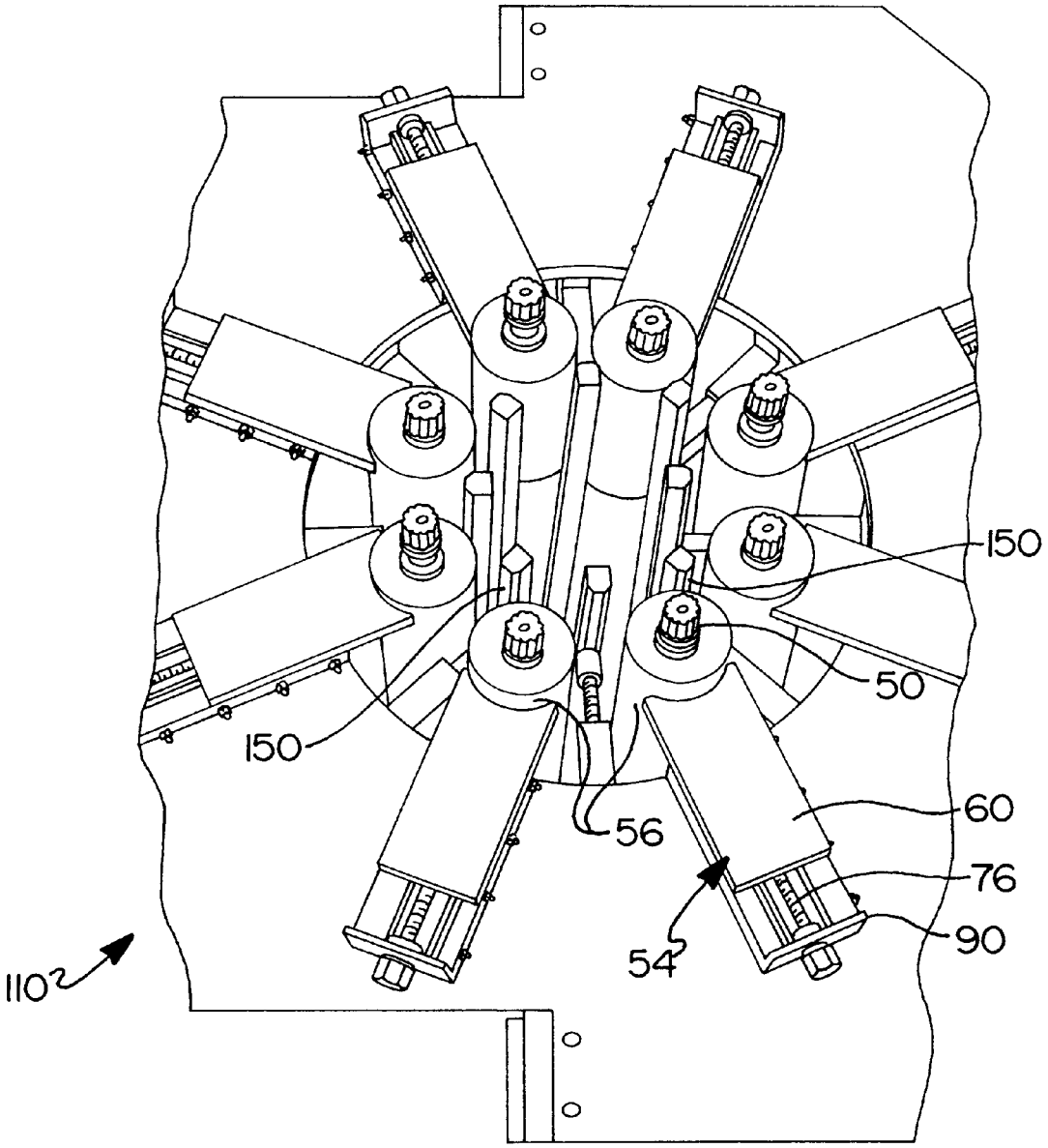
FIG. 5 is a partial perspective view of an apparatus for perforating corrugated tubing in accordance with a second embodiment of the present invention, with the feeder-cutter wheels removed for illustration purposes.

Referring now to FIG. 4, the means 16 for rotating the drive shaft 14 is seen as including a plurality of drive pulleys 32, a plurality of idler pulleys 34, and a belt 36. The drive pulleys 32 are individually mounted upon the rearward portions 26 of the respective drive shafts 14. The belt 36 is wound around the drive pulleys 32 and the idler pulleys 34, which provide tension to keep the belt 36 in tight contact with the drive pulleys 32 when the apparatus 10 is in operation. The means 16 for rotating further includes a transmission 40 in cooperation with an electric motor 42. The transmission 40 has a drive train connected to a sun sprocket 38 as shown, or, alternatively, to one of the drive pulleys 32. This imparts the necessary energy to allow effective operation of the means 16 for rotating the drive shafts 14 and the wheels 12 attached thereto.

Each pair of wheels is oriented on the drive shafts 14 such that the cutters 22 thereof strike the tubing T to make perforations on opposite sides thereof substantially at the same time. The first pair of wheels 12*a* strike the tubing concurrently to create a first set of perforations. The second set of wheels 12*b* then strike the tubing to cut a second set of perforations simultaneously. The wheels 12*b*, preferably, strike approximately 120 degrees later than the wheels 12*a*. The third set of wheels 12*c* then strike the tubing T to simultaneously cut a third set of perforations, the wheels 12*c* striking 120 degrees of rotation after the wheels 12*b* and 240 degrees of rotation after the wheels 12*a*. The coordination of the wheels 12 produces six uniform lines of perforations along the length of the tubing T.

Alternatively, the wheels 12 can each have two cutters 22 disposed thereon in line with the threading 20. The use of two or more threadings can be used in such a design, these multiply-helixed wheels being known as multi-start wheels. The use of multiple cutters 22 on these multi-start wheels results in a slower rotation and therefore a slower throughput of the tubing T. The present invention still achieves a speed well in excess of 50 feet per minute and, thus, provides a significant improvement over known machines. The cutting of the tubing T is helped by synchronizing the striking of each pair of cutters 22, thus lessening the load on the drive equipment.

It is envisioned that the present invention will be capable of accommodating a range of tubing diameters, as desired by a user thereof Thus, one apparatus may perforate tubing in a range of diameters between 2 inches and 6 inches, while another apparatus may perforate tubing in a range of 4 inches to 8 inches in diameter, with various permutations permissible as desired. The present invention eliminates the need of purchasing extra gear works to adapt an apparatus to tubing of different sizes. The additional set-up time needed to synchronize differing sizes of wheels is also saved. A user need only initially synchronize the device and purchase the feeder-cutter wheel sets corresponding to the desired diameters needed by that user. Tubing of diameters within the range serviceable by a particular apparatus 10 can thus be perforated without an additional expenditure of time otherwise necessary in resetting the machinery or in replacing the drive means, such as the gears in previous machines. Savings in time, and in expense for additional machine parts, are therefore realized in using the apparatus 10 according to the present invention.

Referring now to FIGS. 5–8, a second embodiment of an improved apparatus in accordance with the present invention is shown generally at 110. The apparatus 110 has four pairs of feeder-cutter wheels 112 thereon- a first pair 112*a*, a second pair 112*b*, a third pair 112*c*, and a fourth pair 112*d*. The feeder-cutter wheels 112 in this embodiment are substantially similar to those 12 described hereinabove in connection with the first embodiment, each including a worm 118, a helical threading 120 disposed on an outer surface of the worm, and at least one cutter 122, substantially as shown and discussed above in connection with FIG. 2A. In this embodiment, the wheel pairs 12*a* and 12*c* are in a rearward plane, and the wheel pairs 12*b* and 12*d* are in a forward plane, thus achieving the overlapping of the wheels and the associated advantages connected thereto, such as the interchangability of wheel sets to accommodate tubing of different diameters, which are referred to in connection with the apparatus 10 of the first embodiment.

The wheels 112 are mounted on to drive shafts 114, the drive shafts each having a front end portion 119 which is joined to a drive shaft forward portion 124. A first U-joint 128 flexibly interconnects the forward portion 124 to a drive shaft intermediate piece 131, and a second U-joint flexibly interconnects the intermediate piece 131 to a drive shaft rearward portion which is journaled through a back wall of a housing 111 for the apparatus. A drive pulley 132 is attached to the back of the drive shaft rearward portion, and a drive mechanism, which is substantially identical to the means 16 for rotating shown and described in connection with the apparatus 10 according to the first embodiment, is included as part of the apparatus 110, except that it is expanded to accommodate eight feeder-cutter wheels 112.

In this apparatus 110, the worms 118 of the feeder-cutter wheels 112 have splined cylindrical bores 48 formed coaxially therein, for mounting them on to spline gears 50, which are formed on the front end portions 119 of the drive shafts 114 associated therewith.

The primary difference between the apparatus 110 according to the second embodiment and the apparatus 10 according to the first embodiment hereof, aside from the added pair 112*d* of feeder-cutter wheels, is the provision of a wheel adjuster assembly 52, which provides a means for moving each feeder-cutter wheel 112, in a direction which is substantially transverse to the longitudinal axis of its associated drive shaft front end portion 119, to selectively interrupt contact between the feeder-cutter wheels and a portion of corrugated tubing T passing therethrough, so as to leave a longitudinal portion of the tubing unperforated. This wheel adjuster assembly 52 allows a user of the apparatus 110 to custiomize tubing for a particular application, such as, to perforate only a center portion of a length of tubing, or, conversely, to perforate both ends and to leave a center portion untouched.

As shown best in FIG. 8, and as will be set out in further detail hereinbelow, the wheel adjuster assembly 52 is operable to move the feeder-cutter wheels from a first position, shown in phantom, in which the wheels are spaced to make contact with the tubing, to a second position, shown in solid lines in the drawing, in which the wheels 112 are spaced apart to allow the tubing T to pass therebetween without substantial contact therewith.

The wheel adjuster assembly 52 includes identical components for each wheel 112 as follows. A drive shaft sleeve 54 is provided encircling and surrounding part of each drive shaft front end portion 119, and the drive shaft sleeve includes a hollow sleeve cylinder 56 with a sealed bearing 58 disposed coaxially therein. The bearing 58 is provided to accommodate rotation of the drive shaft 114 within the non-rotating sleeve cylinder 56 and to provide long life to the sleeve 54. The drive shaft front end portion 119 is journaled coaxially through the center of the bearing 58. The wheel adjuster assembly 52 also includes a slide plate 60 which is permanently affixed to the sleeve cylinder 56 by welding or the like.

The slide plate 60 makes up a top portion of a slide assembly 65 which is illustrated in FIGS. 7A–7D. The top half of the slide plate 60 consists of a flattened rectangular slab 62, with an arcuate opening 64 formed in one end thereof to join up with and to accommodate the sleeve cylinder 56, which is affixed to the slide plate, as noted. The sleeve cylinder 56 is omitted from FIGS. 7A–7C for purposes of clarity in illustration. The bottom half of the slide plate 60 consists of a wedge-shaped tab 66 extending downwardly from the bottom of the slab 62 and being integrally formed therewith. As shown in FIG. 7C, opposed sides 68, 70 of the wedge-shaped tab 66 flare outwardly as they extend downwardly from the slab 62, with the slide plate 60 terminating in a flattened lower surface 72 at the bottom of the wedge-shaped tab 66. The slide plate 60 also has a hollow, cylindrical smooth-walled bore 74 formed therein starting from an end 75 thereof opposite the arcuate opening 64, and extending longitudinally and centrally about half-way down the slide plate 60. The smooth-walled bore 74 is provided in the slide plate 60 to receive a shaft of a bolt 76 therein, and the bore 74 is large enough in diameter so that the threads 77 of the bolt 76 do not engage with the slide plate 60, which slides freely with respect thereto.

The slide assembly 65 also includes a slide base 78 which is a modified rectangular block, with a wedge-shaped groove 80 formed longitudinally in an upper surface thereof, the groove 80 extending from one end of the slide base to the other for slidably receiving the wedge-shaped tab 66 therein. The wedge-shaped groove 80 has a flat bottom surface and the sides of the wedge-shaped groove slope inwardly as they extend upwardly from the bottom surface thereof. The wedge-shaped groove 80 is dimensioned so that the wedge-shaped tab fits slidably therein, as shown in FIG. 7C,and this cooperation allows the slide plate 60 to slidably move back and forth on the slide base 78.

The slide assembly 65 also includes a stop block 82 which is generally shaped like a piece which has been sliced from the slide plate 60 in a transverse vertical cut; that is to say, it has an upper section 84 which consists of a flattened rectangular slab, and an integral lower section 86 which consists of a wedge-shaped tab that fits engagably and slidably in the wedge-shaped groove 80 of the slide base 78. The stop block 82 is much shorter than the slide plate 60, as shown, and where the slide plate has a smooth cylindrical bore 74 formed centrally therein,in contrast, the stop block 82 has a smaller threaded bore 88 formed centrally therethrough which threadingly and engagably receives the threads 77 of the bolt 76 therein.

The slide assembly 65 also further includes a flattened end plate 90 which is affixed, in a vertical orientation thereof, to an end of the slide base 78 opposite the sleeve cylinder 56, and which has a smooth cylindrical bore 92 formed centrally therethrough to receive a collared locking spacer 94 therein. The collared locking spacer 94, as shown in FIG. 7D, is generally of a cylindrical shape, with a smaller diameter neck portion 95 which is dimensioned to fit snugly, yet freely rotatably, inside the bore 92 of the end plate 90. The collared locking spacer 94 also includes a larger diameter collar portion 96 which is bigger in diameter than the end plate bore 92. The collared locking spacer 94, as shown, also has a threaded bore 98 formed therethrough which is dimensioned to threadably and rotatably engage with the threads 77 of the bolt 76.

Accordingly, the collared locking spacer 94 is placed with the collar portion 96 on the inside of the end plate 90 and the neck portion 95 thereof disposed in the bore 92 of the end plate 90, and then the stop block 82 is slidably inserted in the wedge-shaped groove 82 of the slide base 78. The bolt 76 is then rotatably threaded through the collared locking spacer 94, and also through the stop block 82. The slide plate 60 is then installed in the slide base 78 so that the slide assembly is arranged as shown in FIGS. 7A–7C.

The position of the stop block 82 relative to the end plate 90 can then be adjusted by rotatably unscrewing the collared locking spacer 94 away from the end plate in the groove 82, rotating the bolt until the stop block is in the desired spot, and then turning the collared locking spacer in the other direction until it contacts the end plate and tightening the bolt. Thus locked, the stop block 82 is then operable to limit rearward travel of the slide plate 60 in the slide base 70.

In the apparatus 110, forward travel of the slide plate 60 is limited by a series of eight limiter bars 150, which are arranged in a circular pattern around the longitudinal axis of the tube travel path through the apparatus. The limiter bars 150 are each connected to a support bar 151 for extra support thereof In operation, the slide plate 60 moves forward until the sleeve cylinder 56 contacts the beveled corner edges of two adjacent limiter bars 150.

Referring now to FIGS. 7A and 8, a fluid-operated slave cylinder 152 is shown, which may be housed in a hollow chamber 154 formed inside the stop block 82. The slave cylinder 152 is a hollowed-out cylindrical body which contains a piston 156. The piston 156 is affixed to a push rod 158 which extends outwardly through the cylinder 152 and which is connected to the slide plate 60 to control sliding movement thereof.

The slave cylinder 152 may be operated by compressed air, or alternatively, by hydraulic fluid. In either case, a pair of fluid hoses 160, 162 are connected to, and are in fluid communication with, the slave cylinder 152. In order to move the slide plate 60 forward, fluid under pressure goes through a first hose 160 and applies pressure to a back face 164 of the piston 156, and this moves the piston outwardly in the cylinder to push the slide plate 60 forward with the rod 158. Conversely, to move the slide plate 60 backward, fluid under pressure goes through a second hose 162 and applies pressure to a front face 166 of the piston 156, and this moves the piston inwardly in the cylinder to pull the slide plate 60 backward with the rod 158.

Although the present invention has been described herein with respect to preferred embodiments thereof, the foregoing description is intended to be illustrative, and not restrictive. Those skilled in the art will realize that many modifications of the preferred embodiment could be made and would be operable. All such modifications which are within the scope of the claims are intended to be within the scope and spirit of the present invention.

Having, thus, described the invention, what is claimed is:

1. An apparatus for perforating corrugated tubing, comprising:

a) at least one pair of feeder-cutter wheels, each feeder-cutter wheel comprising a worm, a helical threading disposed at an angle on the worm for intersecting corrugations of corrugated tubing, and a cutter disposed on the worm in line with the threading, b) a drive shaft for each feeder-cutter wheel, each of the drive shafts comprising a front end portion having a longitudinal axis, at least one of the feeder-cutter wheels being coaxially mounted to a front end portion of each of the drive shafts for rotation thereby; and c) means for selectively moving each feeder-cutter wheel in a direction which is substantially transverse to the longitudinal axis of the respective associated drive shaft front end portion, the feeder-cutter wheel being disposed between a first position and a second position, the first position being a position in substantial contact with the tubing, the second position being a position without substantial contact with the tubing, the direction of movement being from the first position to the second position, each means for selectively moving each feeder-cutter wheel comprising:

i) a drive shaft sleeve, the drive shaft sleeve being disposed about each drive shaft front end portion, the drive shaft sleeve including:

a sleeve cylinder disposed about the drive shaft front end portion, the sleeve cylinder being a hollow cylinder;

a sealed bearing, the sealed bearing being disposed coaxially in the sleeve cylinder to accommodate rotation of the drive shaft;

ii) a slide plate, the slide plate being longitudinally affixed to the sleeve cylinder, the slide plate having a top half and a bottom half, the slide plate including:

a slab defining the top half of a slide plate;

a tab extending integrally and outwardly from the bottom portion of the slab, the tab defining the bottom half of the slide plate; a first bore formed formed substantially central to the tab along the longitudinal axis thereof, the bore extending longitudinally therein substantially throughout the tab;

iii) a slide base having a groove formed longitudinally therealong, the tab of the slide plate being slidably movable along the groove;

iv) a fastener which engages the bore, the fastener disposed on the base and projecting therefrom into the bore;

v) an end plate being laterally affixed to the slide base opposite the sleeve cylinder, the end plate having a second bore formed therethrough;

vi) a collared locking spacer for receiving the fastener, the spacer being disposed in the second bore cooperating with the fastener to set a distance between the slide plate and the slide base; and vii) means for moving the slide plate along its path of travel.

2. An apparatus for perforating corrugated tubing, comprising:

a) at least one pair of feeder-cutter wheels, each feeder-cutter wheel comprising a worm, a helical threading disposed at an angle on the worm for intersecting corrugations of corrugated tubing, and a cutter disposed on the worm in line with the threading, b) a drive shaft for each feeder-cutter wheel, each of the drive shafts comprising a front end portion having a longitudinal axis, at least one of the feeder-cutter wheels being coaxially mounted to a front end portion of each of the drive shafts for rotation thereby; and c) a wheel adjuster assembly for each wheel, each assembly selectively moving its associated feeder-cutter wheel in a direction which is substantially transverse to the longitudinal axis of its associated drive shaft front end portion, the feeder cutter wheel being movably disposed between a first position and a second position, the first position being a position in substantial contact with the tubing, the second position being a position without substantial contact with the tubing, the direction of movement being from the first position to the second position, each wheel adjuster assembly comprising:

i) a drive shaft sleeve, the drive shaft sleeve being disposed about each drive shaft front end portion, the drive shaft sleeve including:

a sleeve cylinder disposed about the drive shaft front end portion, the sleeve cylinder being a hollow cylinder;

a sealed bearing, the sealed bearing being disposed coaxially in the sleeve cylinder to accommodate rotation of the drive shaft;

ii) a slide plate, the slide plate being longitudinally affixed to the sleeve cylinder, the slide plate having a top half and a bottom half, the slide plate including:

a slab defining the top half of the slide plate;

a tab extending integrally and outwardly from the bottom portion of the slab, the tab defining the bottom half of the slide plate;

a first bore formed substantially central to the tab along the longitudinal axis thereof, the bore extending longitudinally therein substantially throughout the tab;

iii) a slide base having a groove formed longitudinally therealong, the tab of the slide plate being slidably movable along the grove;

iv) a fastener which engages the bore, the fastener disposed on the base and projecting therefrom into the bore;

v) an end plate being laterally affixed to the slide base opposite the sleeve cylinder, the end plate having a second bore formed therethrough;

vi) a collared locking spacer for receiving the fastener, the spacer being disposed in the second bore cooperating with the fastener to set a distance between the slide plate and the slide base; and vii) means for moving the slide plate along its path of travel.

* * * * *